US007128206B2

(12) United States Patent
Kohler

(10) Patent No.: US 7,128,206 B2
(45) Date of Patent: Oct. 31, 2006

(54) THREE PIECE BEVERAGE CARRIER

(75) Inventor: Karl A. Kohler, Bartlett, IL (US)

(73) Assignee: Smurfit-Stone Container Corporation, St. Louis, MO (US)

( * ) Notice: Subject to any disclaimer, the term of this patent is extended or adjusted under 35 U.S.C. 154(b) by 314 days.

(21) Appl. No.: 10/871,975

(22) Filed: Jun. 18, 2004

(65) Prior Publication Data

US 2005/0230273 A1 Oct. 20, 2005

Related U.S. Application Data

(60) Provisional application No. 60/563,641, filed on Apr. 20, 2004.

(51) Int. Cl.
*B65D 75/00* (2006.01)

(52) U.S. Cl. ..... 206/176; 206/175; 206/193; 229/120.38

(58) Field of Classification Search ..... 206/162, 206/170, 176, 178, 180, 192, 193, 200, 175; 229/117.09, 120.27, 120.36, 120.38
See application file for complete search history.

(56) References Cited

U.S. PATENT DOCUMENTS 3,008,605 A * 11/1961 Vesak ..... 206/166
3,269,636 A 8/1966 Holmes
3,355,012 A * 11/1967 Weiss ..... 206/200
3,610,511 A 10/1971 Engdahl, Jr.
4,243,138 A 1/1981 Wilson
4,319,682 A 3/1982 Wright et al.
4,406,365 A 9/1983 Kulig
4,450,959 A 5/1984 Sommer
4,465,181 A 8/1984 Wood
4,469,222 A * 9/1984 Graser ..... 206/180
4,493,415 A 1/1985 Wood
4,770,294 A * 9/1988 Graser ..... 206/180
5,423,420 A 6/1995 Bakx
5,518,110 A 5/1996 Harrelson
5,538,131 A 7/1996 Harrelson
5,947,273 A 9/1999 Dalrymple et al.
6,041,920 A * 3/2000 Hart et al. ..... 206/175
6,102,197 A 8/2000 Negelen (Continued)

FOREIGN PATENT DOCUMENTS

EP 0035884 A1 9/1981

(Continued)

*Primary Examiner*—David T. Fidei
(74) *Attorney, Agent, or Firm*—Paul M. Denk

(57) ABSTRACT

A three piece beverage carrier has an outer ply, a partition assembly, and a box with the outer ply secured to the partition assembly and the partition assembly expanded and secured to the box. The outer ply comes from a rectangular blank folded lengthwise and the partition assembly comes from another blank that extends the transverse and cross partitions. The box takes shape from a third blank having wall panels and bottom flaps. The bottom flaps fold and glue together forming the bottom of the carrier. The partition assembly includes a transverse partition and at least one cross-partition. The partition assembly blank has a first body section, a second body section, and a handle section. The first and second body sections have a hinged connection at the handle section and form the transverse partition of the assembly. The first and second body sections further include at least one fold out section that defines the at least one cross-partition of the assembly. The outer ply can be printed separately from the box and prior to assembling of the partition assembly.

6 Claims, 6 Drawing Sheets

U.S. PATENT DOCUMENTS

| | | | | |
|---|---|---|---|---|
| 6,168,013 | B1 | 1/2001 | Gomes | |
| 6,230,881 | B1 | 5/2001 | Collura | |
| 6,341,689 | B1 | 1/2002 | Jones | |
| 6,598,739 | B1 | 7/2003 | Collura | |
| 2002/0079237 | A1 | 6/2002 | Bakx | |
| 2002/0179459 | A1 | 12/2002 | Bakx | |
| 2003/0230499 | A1* | 12/2003 | Wagner | 206/216 |

FOREIGN PATENT DOCUMENTS

| | | | |
|---|---|---|---|
| EP | 0282299 | A2 | 9/1988 |

* cited by examiner

THREE PIECE BEVERAGE CARRIER

CROSS REFERENCE TO RELATED APPLICATION

This non-provisional patent application claims priority to the provisional application having Ser. No. 60/563,641, which was filed on Apr. 20, 2004 and to the design patent application having Ser. No. 29/200,049, which was filed on Feb. 18, 2004.

BACKGROUND OF THE INVENTION

The three piece beverage carrier relates to beverage packages in general and more specifically to the divided open top containers for long neck beer bottles. Interlocking longitudinal and transverse partitions become a grid-like divider with the edges of the partitions folded and glued for stiffness. The partitions, when placed in an expanded condition within a carton, receive and separate the bottles from contact with each other.

Basket carriers have had much use carrying bottles of soda, beer, and other beverages. Prior art basket carriers start from a single blank of material. The four walls and the bottom of the carrier, and the partition assembly start as separate flat blanks later folded and formed into a basket for carrying beverages. Complicated machinery performs the intricate folding and gluing that forms a blank into a carrier. Made from a single blank, the carriers do not nest together. Further, printing must be applied to the prior art blanks before assembly of the carriers, adding a step and cost to the production process.

SUMMARY OF THE INVENTION

Generally, the present invention provides a three piece beverage carrier. The carrier comprises an outer ply, a box, and a partition assembly. The partition assembly secures within the box to divide the box into a plurality of bottle receiving cells. The outer ply receives printing and folds over a portion of the partition assembly. The box has two sidewalls, two endwalls, and a bottom. The bottom takes form from folding inward two side flaps and two end flaps that depend from the sidewalls and endwalls respectively. The end flaps parallel the transverse axis of the present invention and fold towards the center of the bottom. The side flaps fold over the end flaps again towards the center of the bottom but cover the end flaps. A line of glue secures one side flap upon the other side flap. When secured, the joint between the sideflaps is offset from the center of the bottom. Preferably, one side flap has a square edge and the other side flap has a tab substantially along the length of the other side flap. The glued bottom and tab lowers the chance of the carrier bottom sagging under the weight of transported bottles therein. In currently available carriers, a center fold increases the sag. Opposite the sideflaps and the endflaps, the sidewalls and the endwalls have linear upper edges. The upper edges can be shaped for different marketing campaigns.

Then the partition assembly has at least one transverse, or cross, partition having a length substantially equal to the distance between the carrier box endwalls and at least one cross partition having a length substantially equal to the distance between the carrier box sidewalls. Each of the partitions has glue tabs along side edges of the partitions that adhere to the inner surface of the carrier box to secure the partition assembly within the carrier box. Formed from a one piece blank, the partition assembly includes a first body section, a second body section, and a handle section. The first and second body sections are hingedly connected to each other at the top of the partition in the handle section and form the transverse divider of the partition. The handle section has a hinged connection to the top of the first and second body sections. The first and second body sections each include at least one fold-out section to define the at least one cross partition. Preferably, the first and second body sections each include two fold out sections to form four dividers, or cross partitions, which go on to define six cells for bottles.

Upon folding the first body portion onto the second body portion, the partition assembly has a handle section. The handle section extends away from the body portions. During assembly, the outer ply is folded lengthwise and placed upon the handle section. The outer ply has two lines of glue to secure the outer ply to the handle section. The outer ply has preprinted indicia placed by the carrier manufacturer or others.

Numerous objects, features and advantages of the present invention will be readily apparent to those of ordinary skill in the art upon a reading of the following detailed description of presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved beverage carrier from separate pieces.

Another object is to provide such a carrier that is easy to assemble.

Another object is to provide such a carrier that is formed from a carrier blank, a partition blank, and an outer ply blank.

Another object is to provide such a carrier with a carrier blank, a partition blank, and an outer ply blank made from different materials and having different coatings to minimize cost.

Another object is to provide such a carrier which has a squared and flatter bottom for sharper appearance.

Another object is to provide an outer ply suitable for inking and laminating an unfinished partition assembly that minimizes decoration of the carrier in hidden portions.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The same reference numerals refer to the same parts throughout the various figures.

DESCRIPTION OF THE PREFERRED EMBODIMENT

Figure 1:
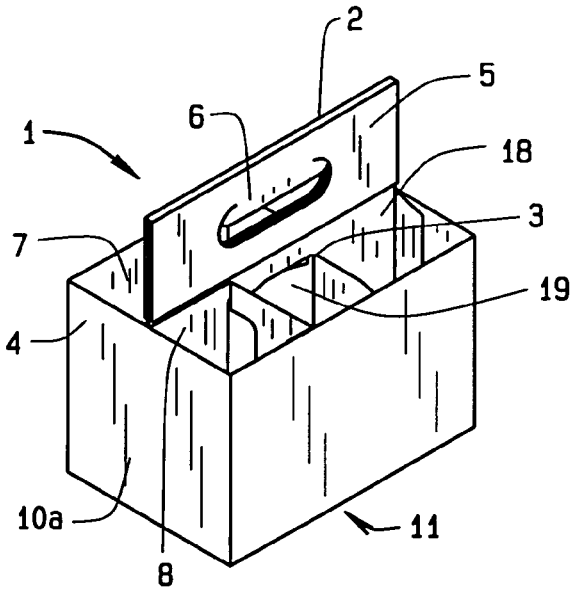
FIG. 1 shows an isometric view of the preferred embodiment of the three piece beverage carrier assembled in accordance with the principles of the present invention.

The present art overcomes the prior art limitations by providing separate pieces for printing and assembly. Beginning on FIG. 1, the preferred embodiment of the three piece beverage carrier 1 has an outer ply 2, a partition assembly 3, and a box 4. The outer ply 2 folds upon and joins a handle section 5 of the partition assembly 3. The outer ply 2 has a generally rectangular scored slot 6 that opens through the handle section 5 through which a person grasps the carrier 1. The partition assembly 3 divides the interior space 7 of the box 4 into a plurality of cells 8, six cells 8 for bottles in the present invention 1. The cells 8 receive and protect individual beverage bottles during shipping. The partition assembly 3 extends for the full height of the present invention 1 and lacks openings of sufficient size for bottles in adjacent cells 8 to contact each other. During movement, the present invention 1 prevents the bottles from damaging each other. The box 4 has two mutually parallel and spaced apart sidewalls 9*a, b* generally parallel to the longitudinal axis of the carrier 1, and two mutually parallel and spaced apart endwalls 10*a, b* generally perpendicular to the longitudinal axis of the carrier 1. The end walls 10*a, b* and the sidewalls 9*a, b* have a generally rectangular shape and beneath, the box 4 has a bottom 11 for the carrier 1.

Figure 2:
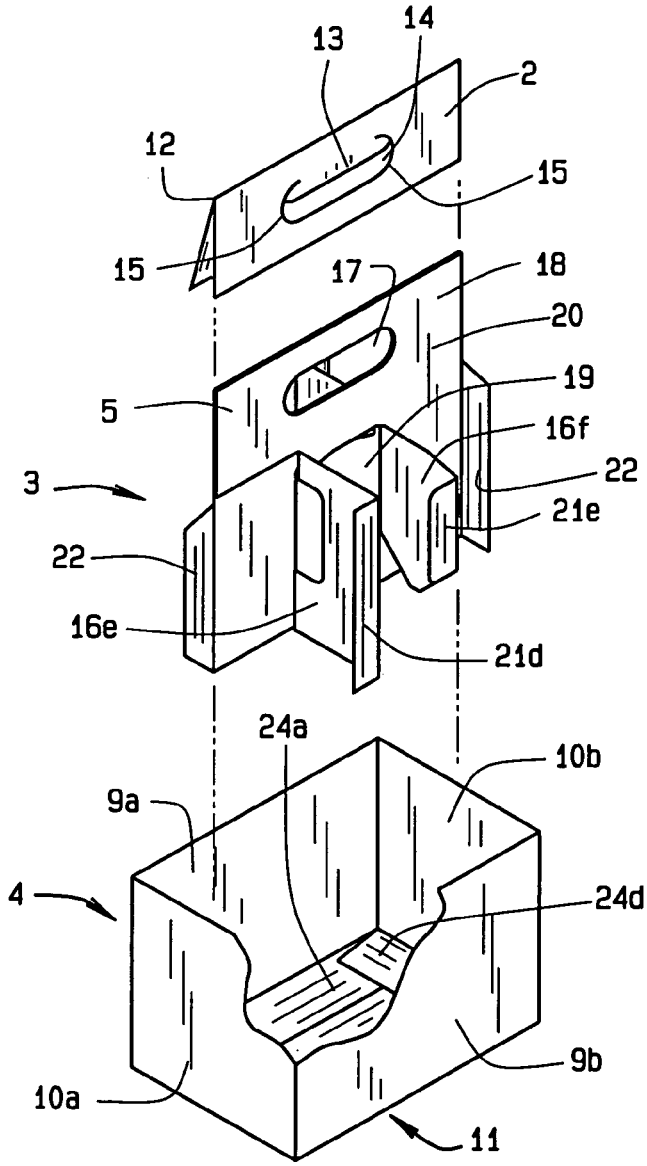
FIG. 2 shows an exploded view of the preferred embodiment of the three piece beverage carrier.

Turning to FIG. 2, the outer ply 2 has a generally rectangular shape with a center fold 12. The center fold 12 is parallel to the longitudinal axis of the outer ply 2 and the carrier 1. Each half of the outer ply 2 has a scored flap 13 that partially detaches from the outer ply 2, forms a slot 14, and bends to admit a person's fingers. The slot 14 has a generally rectangular shape with rounded ends 15.

Then the partition assembly 3 has a generally rectangular shape with a handle section 5 and cross partitions 16 beneath the handle section 5. The cross partitions 16 extend between the sidewalls 9*a, b* of the box 4. The handle section 5 has a shape similar to the folded outer ply 2, and a scored slot 6 that partially detaches from the outer ply 2 that bends to admit fingers. The slot 6 has a generally rectangular shape slightly larger than that in the outer ply 2. The cross partitions 16 fold out from a longitudinal divider 18 and perpendicular to the partition assembly 3 with at least one partition 16 on each side of the handle section 5. Folding out the partitions 16 creates an opening 19 whereby the two middle cells 8 communicate with each other. Between the outer pairs of cells 8, the partition assembly 3 creates a solid wall 20. Opposite the handle section 5, the cross-partitions 16*e, f* have a glue tab 21*d, e* folded perpendicular to the cross-partition 16*e, f*. And opposite the first cross-partition 16*e*, each side of the partition assembly 3 has a glue tab 22 folded perpendicular to the handle section 5. The partition assembly 3 glue tabs 22 are diagonally opposed on each side of the partition assembly 3.

Beneath the partition assembly 3, the box 4 has mutually parallel and spaced apart sidewalls 9*a, b* and mutually parallel and spaced apart endwalls 10*a, b*. The end walls 10*a, b* are perpendicular to the sidewalls 9*a, b*. Beneath the box 4 formed by the sidewalls 9*a, b* and end walls 10*a, b*, the box 4 has a bottom 11. Sideflaps 24*a*, 24*b* folded upon endflaps 24*c*, 24*d* form the bottom 11 that supports the bottles in the cells 8. The sideflaps 24*a*, 24*b* and end flaps 24*c*, 24*d* depend from their respective sidewalls 9*a, b* and endwalls 10*a, b*. Each flap 24*a, b, c* has a hinged connection to each respective wall 9*a, b*, 10*a, b*.

Figure 3:
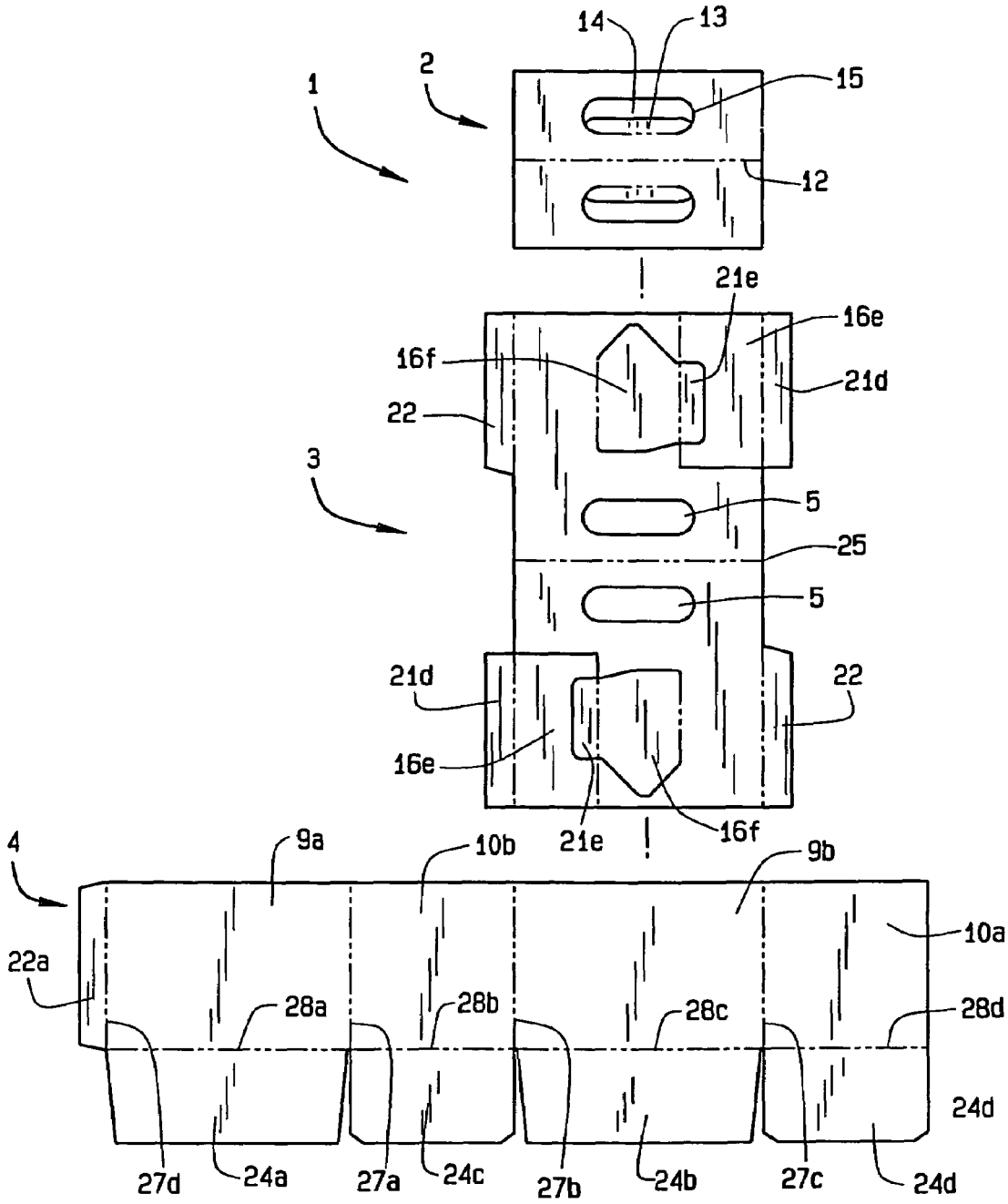
FIG. 3 shows a plan view of the components of the three piece beverage carrier in flat blank form.

Moving to FIG. 3, the present invention 1 starts as three blanks of paperboard in flat form, though other materials may be used. The outer ply 2 has a generally rectangular shape with a center fold 12 parallel to the longitudinal axis of the outer ply 2. Symmetric about the center fold 12, two slots 14 appear in the outer ply 2. A partially attached flap 13 occupies each slot 14. The slot 14 has a generally rectangular shape with rounded ends and each flap 13 has a rectangular shape with one longitudinal edge of the flap 13 connected to the outer ply 2.

Next the partition assembly 3 has a single blank with the cross partitions 16 and glue tabs 21, 22 punched into paperboard. The punching pattern is a mirror image upon a center fold 25 between the upper and the lower halves of the partition assembly 3.

In flat form, the box 4 starts as a single blank and forms a long rectangular shape. The blank divides into four sections 26*a, b, c, d* that correspond to the left and right sides 9*a, b* and the front and back ends 10*a, b*, respectively of the present invention 1. The four sections 26*a, b, c, d* join together as hinges upon fold lines 27*a, b, c*. The rectangular shape has breaks from punching for alternating sidewalls 9*a, b* and end walls 10*a, b* with appended side flaps 24*a, b* and end flaps 24*c, d*. The side flaps 24*a, b* and the end flaps 24*c, d* form the bottom 11 of the box 4 upon folding. The side flaps 24*a, b* and the end flaps 24*c, d* join the sidewalls 9*a, b* and end walls 10*a, b* as hinges upon fold lines 28*a, b, c, d*. Upon the left sidewall 9*a*, a glue tab 22*a* extends outward from a hinged connection upon a fold line 27*d*. The side flaps 24*a, b* have a generally square end 29 opposite the hinged connection with the sidewall 9*a, b*. The end flaps 24*c, d* though have a tapered end 30 opposite the hinged connection with their respective endwalls 10*a, b*. Preferably, a series of elongated scores as the fold line 27*a, b, c, d*, 28*a, b, c, d* ease folding of the blank into the box 4.

Figure 4:
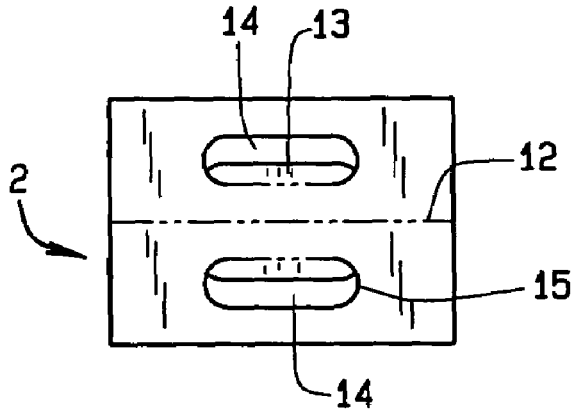
FIGS. 4, 5, and 6 illustrate the outer ply, partition assembly, and carrier box respectively in flat blank form of the three piece beverage carrier.

Over in FIG. 4, the outer ply 2 has a flat rectangular form with a center fold 12 upon the center longitudinal axis. Centered and flanking the fold line 12, two flaps 13 fold beneath the outer ply 2 and towards the center axis of the outer ply 2. The flaps 13 partially attach upon one side of each slot 6 with both flaps 13 attaching towards the center of the outer ply 2. The slots 6 have a generally rectangular shape with rounded ends 15. Lettering and other indicia can be printed upon the outer ply 2 before folding and placement upon the partition assembly 3.

Figure 5:
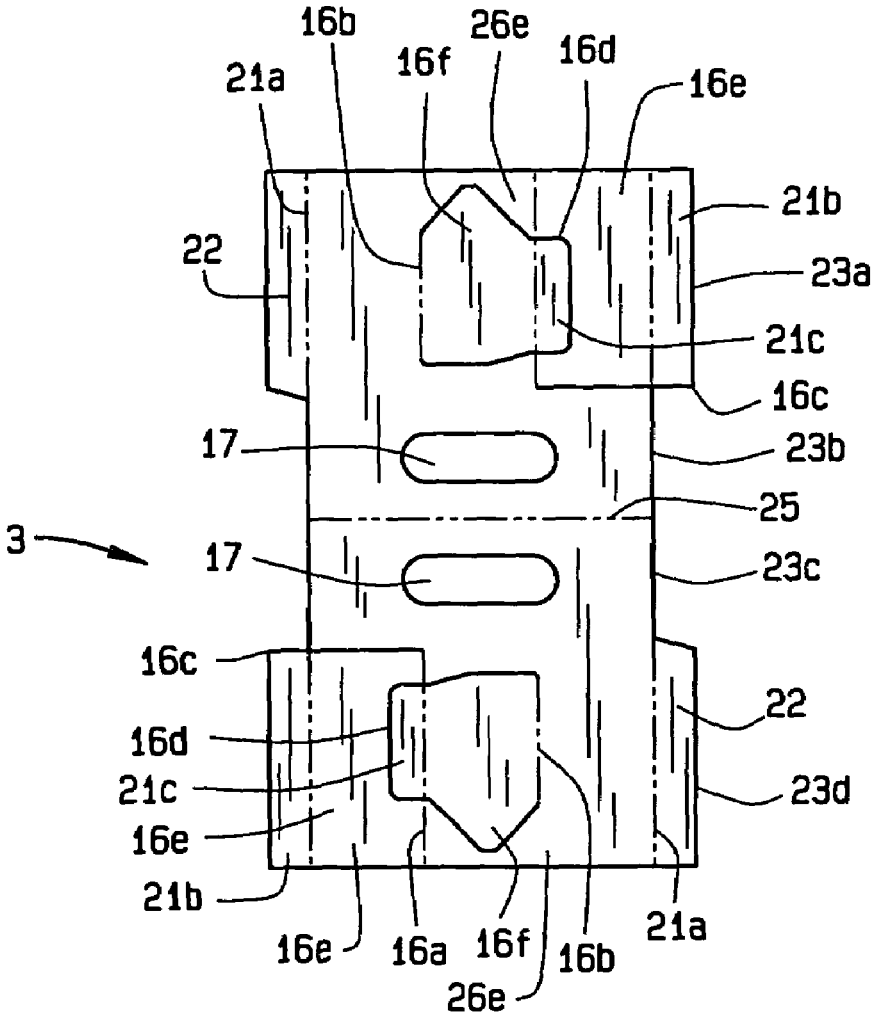

In blank flat form shown in FIG. 5, the partition assembly 3 begins as a single piece of paperboard from which the longitudinal divider 18 and the cross partitions 16 take form. The blank divides into four sections 23*a, b, c, d* separated by the center fold 25 and slices 16*c, d*: the first body 23*a*, the first handle section 23*b*, the second handle section 23*c*, and the second body 23*d*. The first body 23*a* joins by the first handle section 23*b* to the second handle section 23*c* then to the second body 23*d*. The second body 23*d* is the mirror image of the first body 23*a*.

The first body 23*a* and the second body 23*d* have substantial similarities and form the longitudinal divider 18 and the cross partitions 16 that divide the box 4 into cells 8. The first body 23*a* and the second body 23*d* each have a portion that forms the longitudinal divider 18. Glue tabs 22 locate upon the sides of the body sections 23*a, c* and an adhesive strip 22*a* occupies each tab 22. A middle portion 26*e* in the center of the first body 23*a* and the second body 23*d* is defined by a slice 16*d*. The middle sections 26*e* fold about a fold line 16*b* and upon folding, become the second cross-partitions 16*f*. The middle sections 26*e* each have a tab 21*c* with an adhesive strip 21*e*. Slices 16*c* define the form of the first cross-partitions 16*e* that fold out from a fold line 16*a*. These slices 16*c* are parallel with the longitudinal divider 18 and perpendicular to the fold line 16*a* that defines the first cross partition 16*e*.

The first body 23*a* has a generally rectangular shape with a glue tab 22*a* upon one end. The glue tab 22 width is the same as the height of the box 4. Upon a pre-scored line 21*a*, the glue tab 22 folds beneath the first body 23*a* and opposite to the cross partitions 16*e, f*. Then glue tabs 21*b, c* form at the ends of the partitions 16*e, f* dividers opposite the divider's 18 glue tabs 22. The glue tabs 21*b, c* have an adhesive strip 21*d, e* that can be a continuation of the adhesive strip 21*d, e* applied upon an opposite glue tab 21*b, c*. Opposite from the glue tab 22, the first body 23*a* has the first partition 16*e*. The first partition 16*e* has a generally rectangular shape attached on one side 16*a* adjacent to the first body 23*a*. The first partition 16*e* has one side 16*c* cut from the first body 23*a* perpendicular to the fold line 16*a* and adjacent to the first handle section 23*b*. The first partition 16*e* separates from the first body 23*a* and folds until perpendicular to the first body 23*a* where the first partition glue tab 21*b* folds parallel to the second partition glue tab 21*c*. Opposite the glue tab 21*b*, the second partition 16*f* has a polygonal shape with one side 16*b* partially attached to the first body 23*a* and the remaining sides scored to detach from the first body 23*a* at a slice 16*d*. Opposite the attachment side 16*b* and the glue tab 22*a* of the first body 23*a*, the second partition 16*f* has a glue tab 21*c*. Upon a pre-scored slice 16*d*, the second partition 16*f* separates from the first body 23*a* and folds until perpendicular to the first body 23*a* where the second partition glue tab 21*c* folds parallel to the sidewall 9*a, b*. The second body 23*d* has partitions 16*e, f* and glue tabs 21*b, c* in a mirror image to the first body 23*a* and the first body 23*a* descriptions of cross partitions 16*e, f* apply to the second body 23*d* in mirror image.

The first and second handle sections 23*b, c* span between the first body 23*a* and the second body 23*d*. Each handle section 23*b, c* has a generally rectangular shape akin to the outer ply 2. A center fold 25 parallel to the length of the carrier 1 hingedly connects the first handle section 23*b* to the second handle section 23*c*. A centered slot 17 has rounded ends within each handle section 23*b, c*. After the first body 23*a* folds upon the second body 23*d*, the slots 17 accept the flaps 13 from the outer ply 2.

Figure 6:
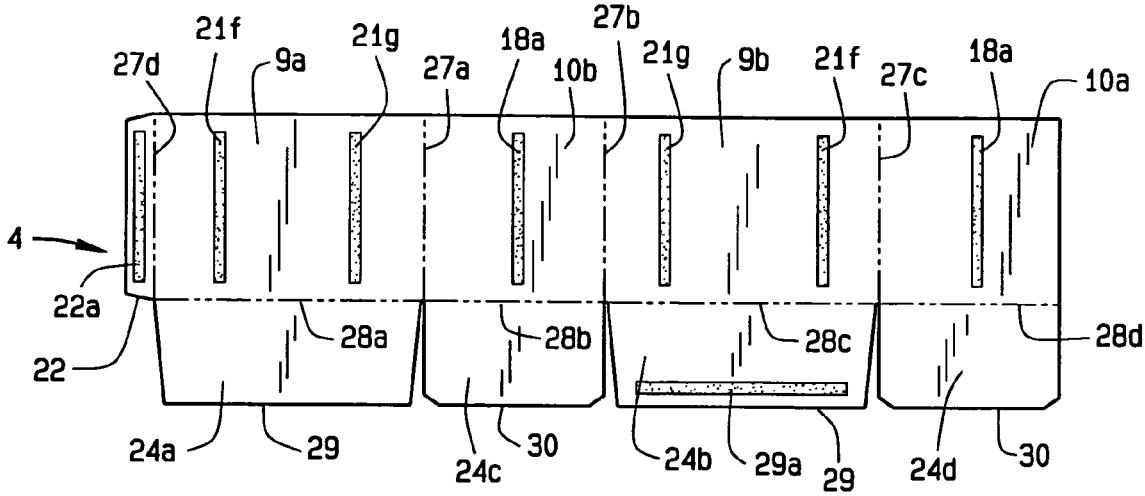

FIG. 6 shows the box 4 in flat blank form prior to folding. The blank divides into four sections that correspond to the front 10*a*, back 10*b*, and the sides 9*a*, 9*b* of the present invention 1. The four sections connect as hinges at fold lines 27*a, b, c*. A glue tab 22 extends across the finished height of the box 4 upon one sidewall. Behind the glue tab 22, sidewalls 9*a, b* and endwalls 10*a, b* alternate position at hinged connections, starting with a sidewall 9*a*. The sidewalls 9*a, b* and endwalls 10*a, b* have generally rectangular shapes with the length of the sidewalls 9*a, b* exceeding that of the endwalls 10*a, b*. Depending from the sidewalls 9*a, b* and the endwalls 10*a, b*, side flaps 24*a, b* and end flaps 24*c, d* respectively fold upon a fold line 28*a, b, c* parallel to the longitudinal axis of the box 4. Preferably, a series of elongated scores as the fold lines 28*a, b, c* ease folding of the blank into the box 4. The side flaps 24*a, b* have a tapered trapezoidal shape with the wider base nearer the box 4. The end flaps 24*c, d* have a rectangular shape with the corners beveled opposite the box 4. The sideflap 24*b* further from the glue tab 22 has a glue strip 29*a* parallel to the longitudinal axis of the box 4 and opposite from fold line 28*c*.

Prior to folding the carrier 1 into a familiar box like shape, machinery applies a series of parallel lines of glue 22*a*, 21*f, g*, and 18*a* upon the box 4. The glue tabs 21*b, c* adhere to the sidewalls 9*a, b* forming the cross-partitions 16*e, f* by the glue lines 21*f, g*. The glue lines 21*f, g* extend from close to the top of sections 26*a, b, c*, and *d* and extend nearly to the bottom 11 of the carrier 1. The glue lines 21*f, g*, 18*a* serve to glue the partition assembly 3 into the box 4 as will be described below.

Figure 7:
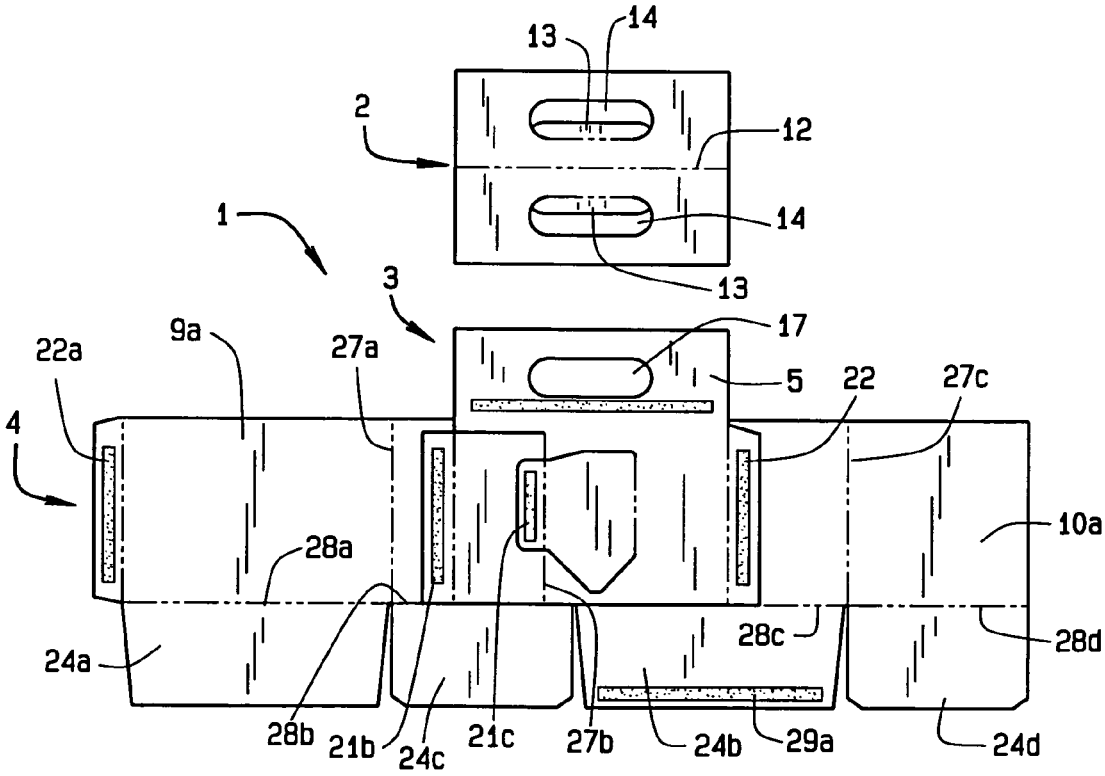
FIG. 7 shows partial assembly of the three piece beverage carrier with the folded partition assembly resting upon the flat box and the outer ply approaching the handle section.
Figure 8:
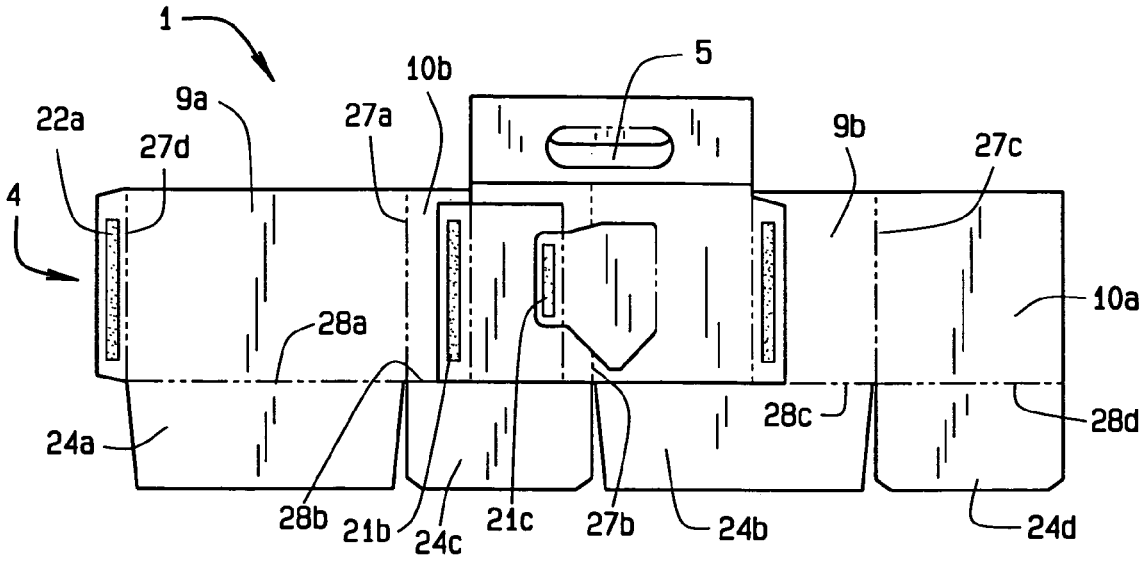
FIG. 8 illustrates further assembly of the three piece beverage carrier with the outer ply secured upon the handle section of the folded partition assembly resting upon the flat box.

With the box 4 remaining flat, FIG. 7 shows the initial assembly of the three piece beverage carrier 1. Rotating the box 4 from FIG. 6, the partition assembly 3 folds upon the box 4. The first body 23*a* folds over the second body 23*d* with the resulting handle sections 23*b, c* positioned away from the box 4. The partition assembly 3 centers upon the sidewall 9*b* further from the glue tab 22*a*. The partition assembly 3 glues into place with glue tabs 21*b, c* upon the inner, or unprinted, surface of the box 4. The cross partitions 16*e, f* remain flat in this figure. The glue tab 22 of the partition 3 adheres to the endwall 10*a* nearer to the glue tab 22*a* of the box 4 and the glue tabs 21*b, c* depending from the cross partitions 16*e, f* adhere to the sidewall 9*b* further from the glue tab 22*a*. These glue tabs 22, 21*b, c* adhere one edge of the longitudinal divider 18 to one end of the box 4 and the cross partitions 16*e, f* to a side of the box 4. With the handle sections 23*b, c* in position upon the box 4, the outer ply 2 is folded along its fold line 12 and moved towards the handle sections 23*b, c*. Next in FIG. 8, the outer ply 2 folds upon the handle 5 with the flaps 13 of the outer ply 2 extending into the slots 17 of the handle 5.

Figure 9:
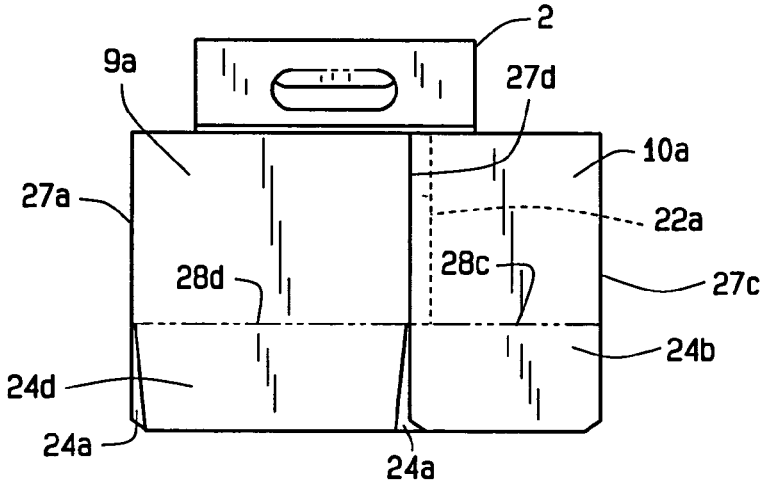
FIG. 9 shows an endwall and a sidewall folded over and secured to the partition assembly in preparation for final assembly of the three piece beverage carrier; and, FIG. 10 shows a bottom view of the three piece beverage carrier with the partition assembly installed and glued into the box and the side flaps and end flaps preparing to close and to form the bottom of the three piece beverage carrier.

Then in FIG. 9, the box 4 is folded along the fold line 27*b* as the partition assembly 3 is brought over and upon the endwall 10*b* and sidewall 9*a* closer to the glue tab 22*a*. The endwall 10*a* formerly further from the glue tab 22*a* receives the glue tab 22*a* and joins the sidewall 9*a* to the second endwall 10*a*. This adheres the longitudinal divider 18 to the endwall 10*a* and the cross partitions 16*e, f* to the other sidewall 9*a* of the box 4. Folding the glue tab 22*a* on fold line 27*d* and the fold lines 27*a, b, c* between the sidewalls 9*a, b* and the endwalls 10*a, b* rotates the box 4 into a rectangular configuration. Upon gluing of the tabs 22, 22*a*, 21*b, c* to the endwalls 10*a, b* and sidewalls 9*a, b* respectively, the carrier 1 achieves an assembled, but flattened state. The beverage carrier 1 stores and ships flat prior to forming the bottom 11 of the beverage carrier 1 at the bottler.

Figure 10:
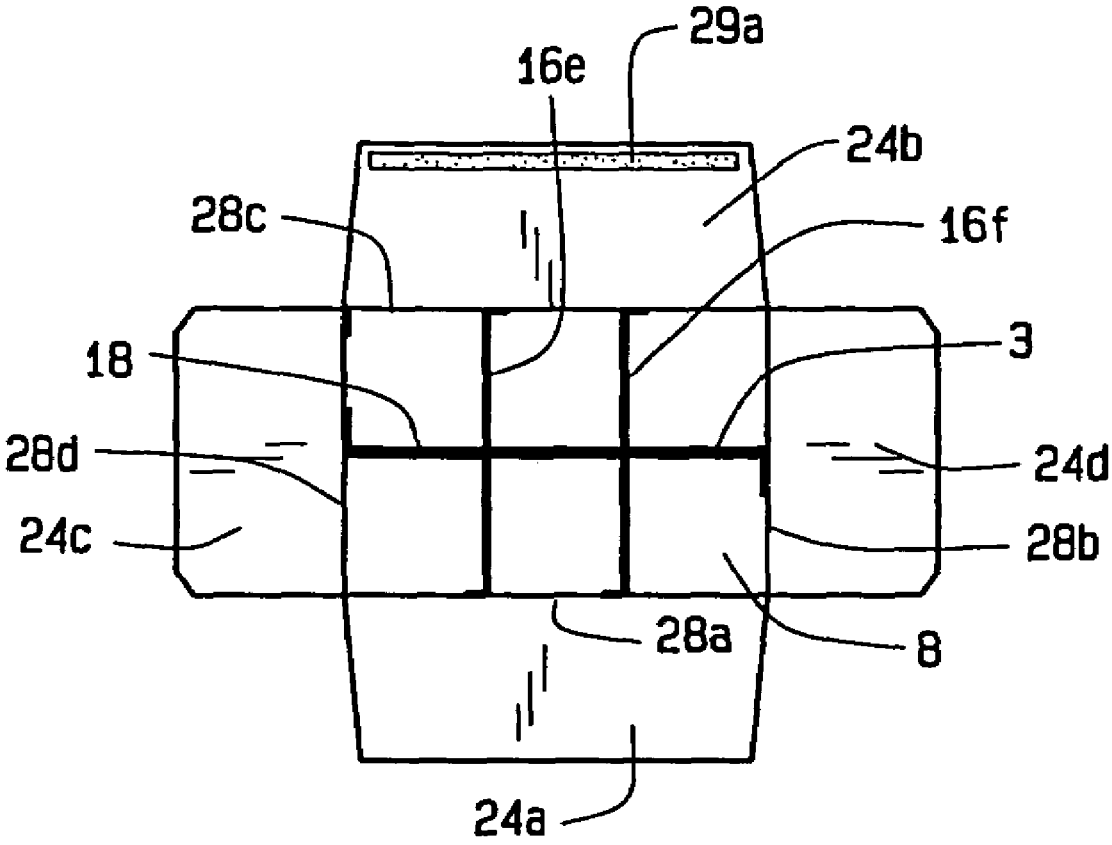

FIG. 10 has the box 4 in a rectangular configuration wherein the cross partitions 16*e, f* unfold. The cross partitions 16*e, f* are perpendicular to the sidewalls 10*a, b* while the glue tab 21*b, c* of each cross partition 16*e, f* adheres parallel to a sidewall 10*a, b*. At each end of the partition assembly 3, a glue tab 22 adheres the first body 23*a* and the second body 23*d*, and to the endwalls 10*a, b* of the box 4. To form the carrier 1, the box 4 expands from the flattened state shown in FIG. 9. The unfolded cross partitions 16*e, f* form cells 8 suitable for bottles. With the partition assembly 3 joined to the box 4, the bottom 11 of the carrier 1 forms by folding the end flaps 24*c, d* towards the center of the carrier 1 and upon the partition assembly 3. Then the sideflaps 24*a, b* fold upon the end flaps 24*c, d* with the sideflap 24*a* folding first and the other sideflap 24*b* securing to the glue strip 29*a*. The glue strip 29*a* holds the bottom 11 together. With the bottom 11 formed a bottler inserts bottles into the carrier 1 and ships the loaded carrier 1 to market.

From the aforementioned description, a three piece beverage carrier has been described. The three piece beverage carrier is uniquely capable of receiving printing in separate pieces before assembly of the carrier. The three piece beverage carrier and its various components may be manufactured from many materials including but not limited to paperboard, cardboard, chip board, polymers, high density polyethylene HDPE, polypropylene PP, polyethylene terephalate ethylene PETE, polyvinyl chloride PVC, polystyrene PS, nylon, ferrous and non-ferrous metal foils, their alloys, and composites.

The phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A beverage bottle carrier comprising an outer ply, a partition assembly, and a box;

said outer ply formed from a separate blank;

said box formed from a separate blank having two sidewalls, two endwalls, and a bottom; said bottom being made of two side flaps and two end flaps depending from said sidewalls and said endwalls respectively, said side flaps and said end flaps being secured to each other, and said side flaps being sized to meet at a joint beneath said carrier; and, said partition assembly formed from a separate blank and defining a longitudinal divider having a length substantially equal to the distance between said endwalls and at least one cross-partition having a length substantially equal to the distance between said sidewalls, said partition assembly including:

a first body section, a second body section, a first handle section and a second handle section; said first and said second body sections being hingedly connected at a fold line between said first handle section and said second handle section, upon folding said first handle section upon said second handle section, said first and said second body sections define the longitudinal divider; said first and second body sections each including at least one fold-out section to define the at least one cross-partition;

wherein said outer ply folds over said first handle section and said second handle section, said partition assembly fits within said box to divide said box into a plurality of bottle receiving cells and said partition assembly secures to said box, and said box encloses the bottom of said beverage bottle carrier.

2. The beverage bottle carrier of claim 1 wherein said outer ply has a generally rectangular shape similar to said handle and the resulting handle of said carrier has at least four plies.

3. The beverage bottle carrier of claim 2 wherein said first body section and said second body section include a glue line on a side thereof to define glue tabs for said longitudinal divider and glue lines on said fold out sections to define a glue tab for said cross-partitions.

4. The beverage bottle carrier of claim 3 wherein each of said body portions of said partition assembly includes two fold-out sections; said partition assembly having four cross-partitions to define six bottle receiving cells in said carrier.

5. The beverage bottle carrier of claim 2 wherein said endwalls and said sidewalls of said carrier box have substantially linear edges.

6. The beverage bottle carrier of claim 2 wherein said outer ply has a surface suitable for printing indicia.

* * * * *